US010783804B1

(12) United States Patent
Pointer

(10) Patent No.: US 10,783,804 B1
(45) Date of Patent: Sep. 22, 2020

(54) GREETING CARD HOLDER

(71) Applicant: Alisa Pointer, Evanston, IL (US)

(72) Inventor: Alisa Pointer, Evanston, IL (US)

( * ) Notice: Subject to any disclaimer, the term of this patent is extended or adjusted under 35 U.S.C. 154(b) by 0 days.

(21) Appl. No.: 16/547,879

(22) Filed: Aug. 22, 2019

Related U.S. Application Data

(60) Provisional application No. 62/742,690, filed on Oct. 8, 2018.

(51) Int. Cl.
*G09F 1/10* (2006.01)

(52) U.S. Cl.
CPC ..... *G09F 1/10* (2013.01)

(58) Field of Classification Search
CPC .. G09F 1/10; B42F 11/02; A47F 7/143; A47F 5/04; A47F 5/05; A47F 5/06; A47F 5/08
USPC ..... 40/124, 396; 211/45; 281/48
See application file for complete search history.

(56) References Cited

U.S. PATENT DOCUMENTS 3,170,260 A 2/1965 Parker
3,789,526 A * 2/1974 Lavinson ..... G09F 1/10 40/124
3,998,334 A * 12/1976 Smith ..... A47F 5/02 211/45
4,186,503 A 2/1980 Fontana
4,326,349 A 4/1982 Daughtry
4,852,280 A * 8/1989 Beattie ..... B42F 11/02 40/124
5,088,216 A * 2/1992 Wasilko ..... A47G 7/06 206/423
5,480,036 A * 1/1996 Opar ..... A47F 5/04 211/163
6,254,135 B1 7/2001 Girard
7,527,235 B2 5/2009 Hummel

* cited by examiner

*Primary Examiner* — Joanne Silbermann
(74) *Attorney, Agent, or Firm* — Adrienne B. Naumann

(57) ABSTRACT

The new greeting card holder preferably comprises at least one rigid longitudinal component combined with at least one flexible longitudinal band and at least one laterally oriented flexible ring. Each flexible longitudinal band extends the entire longitudinal length of a single corresponding rigid longitudinal component. Each laterally oriented flexible ring preferably encompasses one rigid longitudinal component approximately perpendicular or exactly perpendicular to at least one longitudinal flexible band along the rigid longitudinal component. In the preferred embodiment the greeting card holder also comprises at least one mechanical device that attaches a rigid longitudinal component in parallel alignment to another structure or structures. In other embodiments the greeting card holder comprises at least one rigid longitudinal component attaching perpendicular to a rigid polyhedron or rigid longitudinal polyhedron.

12 Claims, 9 Drawing Sheets

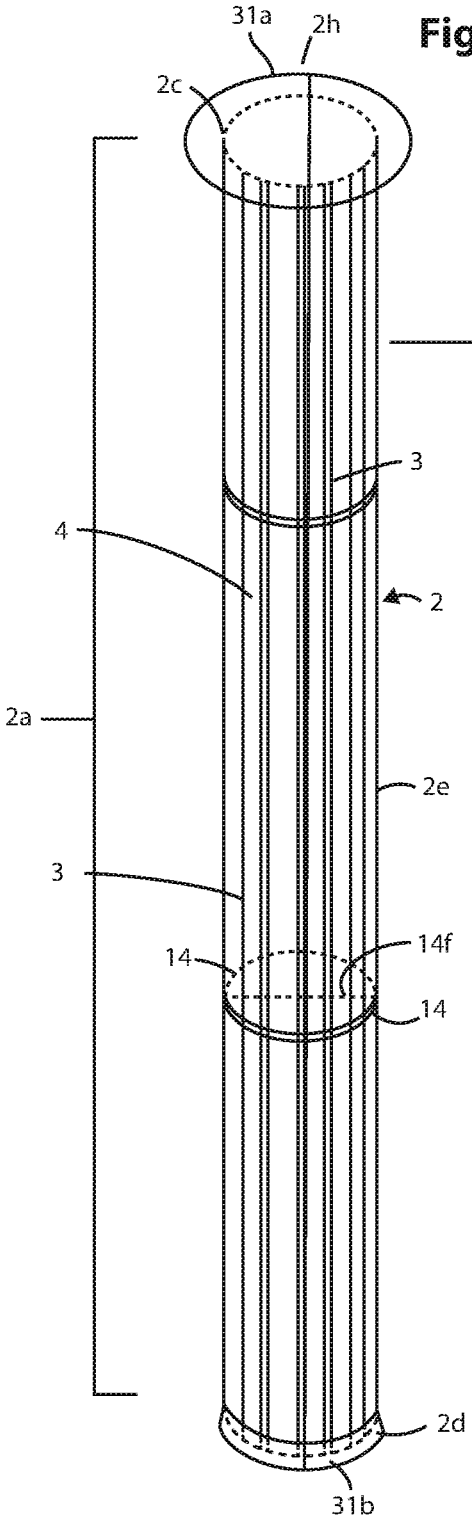
Fig. 2
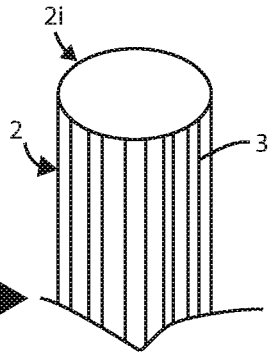
Fig. 2A
Fig. 2B
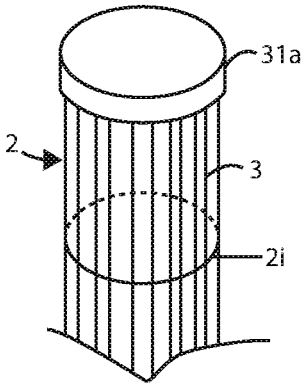

GREETING CARD HOLDER

BACKGROUND OF INVENTION

This application directly originates from parent U.S. provisional application 62/742,690.

This invention is directed to a new device for (i) reversibly and interchangeably displaying at least one document in axial alignment along a rigid longitudinal component and (ii) whereby a viewer may observe both of at least one document's interior surfaces and exterior surfaces. More specifically this invention is directed to a greeting card holder which displays at least one greeting card or at least one other document in preferably an axial alignment along at least one rigid cylindrical component. Even more specifically, this invention is directed to a greeting card holder by which at least one greeting card or another document (i) reversibly inserts under at least one flexible longitudinal band along the longitudinal length of a rigid longitudinal component, and (ii) wherein the at least one greeting card or other document is in axial, but not necessarily linear alignment with other greetings cards or other documents.

Even more specifically, this invention is directed to at least one rigid longitudinal component that either (i) attaches to another structure or structures, or (ii) attaches to a rigid polyhedron or a rigid longitudinal polyhedron wherein (iii) the rigid polyhedron or rigid longitudinal polyhedron are preferably supported by, and physically contact a lowermost surface. Typically, people display greeting cards until the appropriate event or holiday passes. Thereafter they often haphazardly store these cards in a drawer, box, or bag, where are often interspersed with stacks of papers and other clutter. Some people tape their most cherished greeting cards to walls, but the tape can lose its stickiness. The greeting cards may then unattach and become inconveniently irretrievable to a busy person, especially if the greeting cards fall between furniture and a closely adjoining wall or another vertical surface.

Accordingly, there is a long-felt need for a device by which to secure greeting cards and other documents for continuous display, and preferably within a single location. U.S. Pat. No. 6,254,135 (Girard) discloses an album for this purpose, but it cannot vertically display cards without the album covers. U.S. Pat. No. 4,186,503 (Fontana) discloses a greeting card display assembly which simulates the exterior profile of an evergreen tree, and which comprises rigid attached slats. However, Fontana does not display axially positioned greeting cards or other documents so greeting cards or other documents simultaneously display both anterior and posterior leaf surfaces. U.S. Pat. No. 4,326,349 (Daughtry) discloses a greeting card display device in which only a single greeting card is displayed vertically and in exclusively an exposed interior card surface position.

U.S. Pat. No. 3,170,260 (Parker) discloses a greeting card display holder comprising attached greeting cards along a single vertical component, and these greeting cards vertically align with each other. However, this single vertical support is not rigid, because it comprises two flexible ribbons, and does not attach to other structures. Parker also requires a separate set of rigid rings to present greeting cards or other documents from slipping along the two flexible ribbons and abutting a second card or document. U.S. Pat. No. 7,527,235 B2 (Hummel) discloses a greeting card holder that comprises a single horizontal flat stiff support which attaches to a single greeting card. This greeting card is attached by integral tabs of the support to the support's upper surface, while the card is displayed within a tent position or a vertical position to the upper surface.

In sum, none of these above previously existing card holders comprise:

(i) at least one rigid longitudinal component which displays at least one greeting card or at least one document in a reversible axial position, (ii) at least one laterally oriented flexible ring which is exactly or approximately perpendicular to the longitudinal length of a combined rigid longitudinal component, and (iii) where at least one greeting card or other document inserts behind at least one flexible longitudinal band, while (iv) the one greeting card or other document is maintained at a predetermined position along the combined rigid longitudinal component by a laterally oriented flexible ring.

This new greeting card holder may also comprise decorative laterally oriented flexible ring(s) and/or multicolored longitudinal flexible band(s) for a more aesthetic appearance. The new greeting card holder also assists in business settings to conveniently display documents for a particular project or other utilities. When such a project is complete, these documents are easily removed and different documents attached for a subsequent project or utility.

SUMMARY OF THE INVENTION

In the preferred embodiment the present invention comprises a new greeting card holder which (i) aligns perpendicular to a supporting surface, and (ii) parallel to the exterior surface of another structure such as a wall. The greeting card holder comprises at least one rigid longitudinal component, at least one longitudinal flexible band, at least one laterally oriented flexible ring, and at least one mechanical attachment to the separate another structure such as a wall.

More particularly, a single longitudinal rigid component most preferably comprises a cylinder. Along the longitudinal length of the rigid longitudinal component is at least one flexible longitudinal band, but more preferably there are at least three flexible longitudinal bands. Each flexible longitudinal band is preferably spaced from and adjoining the remaining flexible bands along the longitudinal length and longitudinal axis of the rigid longitudinal component (i) in approximate or exact parallel longitudinal alignment with each other along the rigid exterior surface of the rigid longitudinal component. Each flexible longitudinal band also preferably completely, integrally continuously extends, and may attach, to both the first end and second end of a rigid longitudinal component. However, most preferably each flexible longitudinal band attaches to (i) a first rigid cap and a second rigid cap, or (ii) a first rigid cap or a second rigid cap.

Positioned directly above, adjacent to and contacting at least one flexible longitudinal band is at least one laterally oriented flexible ring. Each laterally oriented flexible ring is preferably approximately or exactly perpendicular to the at least one flexible longitudinal band along the same single rigid longitudinal component. Each laterally oriented flexible ring is preferably sufficiently axially spaced from an adjoining laterally oriented flexible ring to insert a greeting card or other document between these same two laterally oriented flexible rings. Each greeting card or other document preferably comprises at least one first leaf and at least one second leaf, and each leaf preferably comprises an interior leaf surface and an exterior leaf surface. Preferably located between the at least one first leaf and at least one second leaf of this same greeting card or other document is a longitudinal fold. This longitudinal fold is preferably continuous, linear, integral and extends from (i) a greeting card upper edge or other document upper edge to (ii) the greeting card bottom edge or other document bottom edge.

Each greeting card or other document preferably reversibly attaches to a rigid longitudinal support by inserting the longitudinal fold between (i) the exterior rigid surface of the rigid longitudinal support, and (i) one flexible longitudinal band extending along the same rigid longitudinal component. In the preferred embodiment the spatial orientation of the greeting card holder comprises (i) the longitudinal axis and longitudinal length of the rigid longitudinal component (ii) as parallel to the longitudinal exterior contour of another structure or structures to which the rigid longitudinal component attaches. Most preferably these other structures are perpendicular to a lowermost contacting supporting surface. In this preferred manner each leaf simultaneously displays both its respective interior and exterior surfaces in a vertical orientation to a viewer.

Each greeting card or other document is more preferably maintained at a predetermined axial position (i) between a single rigid longitudinal component exterior surface and at least one flexible longitudinal band along a single rigid longitudinal component, and (ii) by least one laterally oriented flexible ring.

Laterally oriented flexible rings axially align along and encompass perpendicular cross-sectional perimeters of a single rigid longitudinal component. Preferably, to maintain at least one greeting card or at least one other document at a predetermined axial position along a single rigid longitudinal component, at least one laterally oriented flexible ring (i) contacts the lower edge of an inserted greeting card or other document, (ii) at or proximal to the longitudinal fold of an inserted greeting card or other inserted document.

A laterally oriented axial ring may also be completely covered and compressed by an upper adjacent positioned congruently aligning bracket or other mechanical attaching device which attaches the rigid longitudinal component to another structure or structures.

No less than one laterally oriented flexible ring should frictionally engage the rigid exterior surface of a rigid longitudinal component as well at least one flexible longitudinal band. There should also be sufficient friction to prevent an inserted greeting card or other document from sliding along rigid longitudinal component by contacting the lower second edge of a greeting card or other document proximal to or at the longitudinal fold. More preferably, in the preferred embodiment and other embodiments there are at least two laterally oriented axially positioned laterally oriented flexible rings for this purpose, and each laterally oriented flexible ring may engage more than one lower second edge. In the preferred embodiment a single bracket congruently covers one corresponding laterally oriented flexible ring so an inserted greeting card or other document lowermost edge abuts the bracket upper edge. In other embodiments, a laterally oriented flexible ring abuts the greeting car or other document lowermost edge. In still other embodiments comprising mechanical fasteners other than brackets, a laterally oriented flexible ring may or nay not be the component which abuts the greeting card or other document lowermost edge.

In the preferred embodiment at least one rigid longitudinal component most preferably attaches to at least one other structure, such as a wall. In this embodiment the rigid longitudinal component longitudinal length is parallel to the surface of the at least one other structure to which the at least one rigid longitudinal component attaches. In other embodiments (i) the longitudinal length and longitudinal axis of single attaching rigid longitudinal component (ii) are parallel to the linear longitudinal location where these two converging surfaces form a three-dimensional converging angle.

In still other embodiments a rigid longitudinal component attaches to two diverging surfaces where (i) the longitudinal length and longitudinal axis of the rigid longitudinal component are exactly or approximately parallel (ii) to the linear longitudinal location where these two diverging surfaces form a three-dimensional diverging angle.

In other embodiments at least one rigid longitudinal component only attaches at a first longitudinal end or a second longitudinal end. The single rigid longitudinal component is preferably exactly or approximately perpendicular to, and only attaches to a single rigid polyhedron which may or may not be continuously and integrally solid. This rigid polyhedron is preferably supported either approximately perpendicular, or exactly perpendicular, to and upon a flat surface. Either of the first longitudinal end or the second longitudinal end of a single rigid longitudinal component also preferably attaches to the rigid polyhedron.

In other embodiments each single rigid longitudinal component extends, by either a first longitudinal end or a second longitudinal end, from a rigid longitudinal polyhedron in a perpendicular manner. A single rigid longitudinal polyhedron may or may not be continuously solid. This rigid longitudinal polyhedron may function as a table with or without legs while displaying greeting cards or other documents upon numerous extending rigid longitudinal components which preferably attach to a rigid longitudinal polyhedron.

Therefore, one goal of the greeting card holder is the reversible and interchangeable axial display of at least one greeting card or another document along a single rigid longitudinal component.

It is another goal of the invention to display at least one greeting card or other document which are easily viewed at both interior leaf surfaces and exterior leaf surfaces.

It is another goal of the invention to reversibly and interchangeably display at least one greeting card or other documents in vertical alignment to a lowermost supporting surface.

It is another goal of the invention to display greeting cards or other documents so the greeting card holder longitudinally attaches to at least one another structure in parallel alignment.

It is another goal of the invention to provide a rigid longitudinal polyhedron to which more than one rigid longitudinal component attaches.

It is another goal of this invention to display at least one greeting card and/or other documents without applying adhesive to walls or other structures for attachment.

These advantages and other advantages will become clearer after review of the

DESCRIPTION OF THE FIGURES

FIG. 2 illustrates a partial anterior view of a rigid longitudinal component combined with longitudinally aligned single flexible longitudinal bands and two laterally oriented flexible rings in the preferred embodiment.

FIG. 2A illustrates a cutout enlarged upper portion of FIG. 2 without a lower longitudinal cap or a lower longitudinal cap, but with paired flexible longitudinal bands.

FIG. 2B illustrates FIG. 2A with a first rigid cap.

DETAILED DESCRIPTION OF THE PREFERRED EMBODIMENT AND OTHER EMBODIMENTS

Introduction

Figure 1:
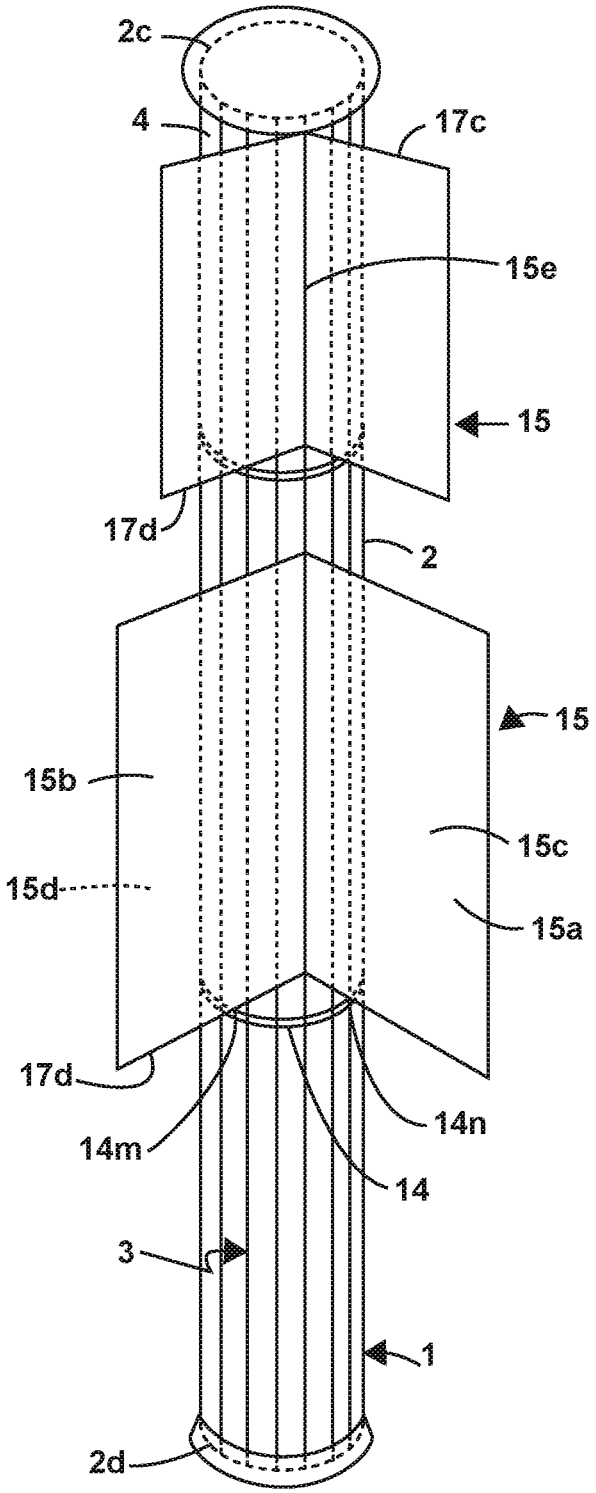
FIG. 1 illustrates a partial anterior view of a rigid longitudinal component combined with longitudinally aligned single flexible longitudinal bands, laterally oriented flexible rings and attached greeting cards or other documents in the preferred embodiment.

The new greeting card holder 1 [hereinafter greeting card holder 1] described herein comprises the following in the preferred embodiment:

(i) at least one rigid longitudinal component 2;
(ii) at least one flexible longitudinal band 3;
(iii) at least one laterally oriented flexible ring 14;
(iv) mechanical fasteners 5 that attach at least one rigid longitudinal component 2 to another structure 6 or other structures 6*h*, 6*i*, or 6*f*, 6*g*; and
(v) most preferably a first rigid cap 31*a* and a second rigid cap 31*b*.

In other embodiments greeting card holder 1 comprises
(i) at least one rigid longitudinal component 2;
(ii) at least one flexible longitudinal band 3;
(iii) at least one laterally oriented flexible ring 14;
(iv) at least one rigid polyhedron 9 or at least one rigid longitudinal polyhedron 11, and
(v) most preferably one first rigid cap 31*a* or a second rigid cap 31*b*.

Elongated Rigid Longitudinal Component 2

Referring now to FIGS. 1, 2, 2A and 2B, in the preferred embodiment and other embodiments greeting card holder 1 comprises an elongated rigid longitudinal component 2 which may or may not be completely or partially hollow [hereinafter 'rigid longitudinal component 2']. More preferably, rigid longitudinal component 2 is cylindrical in shape and comprises longitudinal sections 4 along and parallel to longitudinal length 2*a* of rigid longitudinal component 2. Longitudinal sections 4 are defined by flexible longitudinal flexible bands 3, and where flexible longitudinal bands 3 are described infra. Each at least one rigid longitudinal component 2 also preferably comprises (i) a maximum perpendicular cross-sectional perimeter 2*i*;
(ii) a single first rigid end 2*c*; and
(iii) a single second rigid end 2*d*; and
(iv) a single rigid longitudinal component longitudinal axis 2*h* [hereinafter 'longitudinal axis 2*h*'].

Rigid longitudinal component 2 may comprise any suitable color, design or indicia thereon, and preferably first rigid end 2*c* and second rigid end 2*d* are interchangeable with each other. Also, in the preferred embodiment greeting card holder 1 most preferably comprises
(i) a single first rigid cap 31*a* encompassing first rigid end 2*c*, and
(ii) a single second rigid cap 31*b* encompassing second rigid end 31*b*.

In other embodiments greeting card holder 1 may not comprise a single first rigid cap 31*a* or second rigid cap 31*b*, or greeting card holder 1 may comprise more than one first rigid cap 31*a* or one second rigid cap 31*b*. Rigid longitudinal component 2 preferably comprises a continuous integral rigid exterior surface 2*e* [hereinafter 'rigid exterior surface 2*e*'].

Mechanical Fasteners 5

As best seen in FIGS. 3, 5, 8 and 9, in the preferred embodiment at least one mechanical fastener 5 attaches a single rigid longitudinal component 2 to another structure 6. Rigid longitudinal component 2 may also continuously and congruently lodge within a single linear converging longitudinal corner 6*c* formed by adjacently contacting two another structures 6*h* and 6*i*. Preferably longitudinal axis 2*h* is (i) exactly parallel, or approximately parallel to, to this linear converging longitudinal corner 6*c*, and (ii) congruently aligns with and within linear converging longitudinal corner 6*c*.

Rigid longitudinal component 2 may also attach to two adjacent and diverging another structures 6*f* and 6*g* that together form a single outwardly diverging linear longitudinal corner 6*d*. Rigid longitudinal component 2 is then preferably located along a single linear continuous diverging corner 6*d*. In this preferred position, rigid longitudinal component 2 also congruently aligns with and within linear converging corner 6*d*. However, other locations and spatial positions of at least one rigid longitudinal component 3 are also within the scope of the pending invention. Most preferably in the preferred embodiment another structure 6, two another structures 6*h*, 6*i* or 6*f*, 6*g* are longitudinally perpendicular to a supporting contacting surface 8, but this need not be the case.

Figure 3:
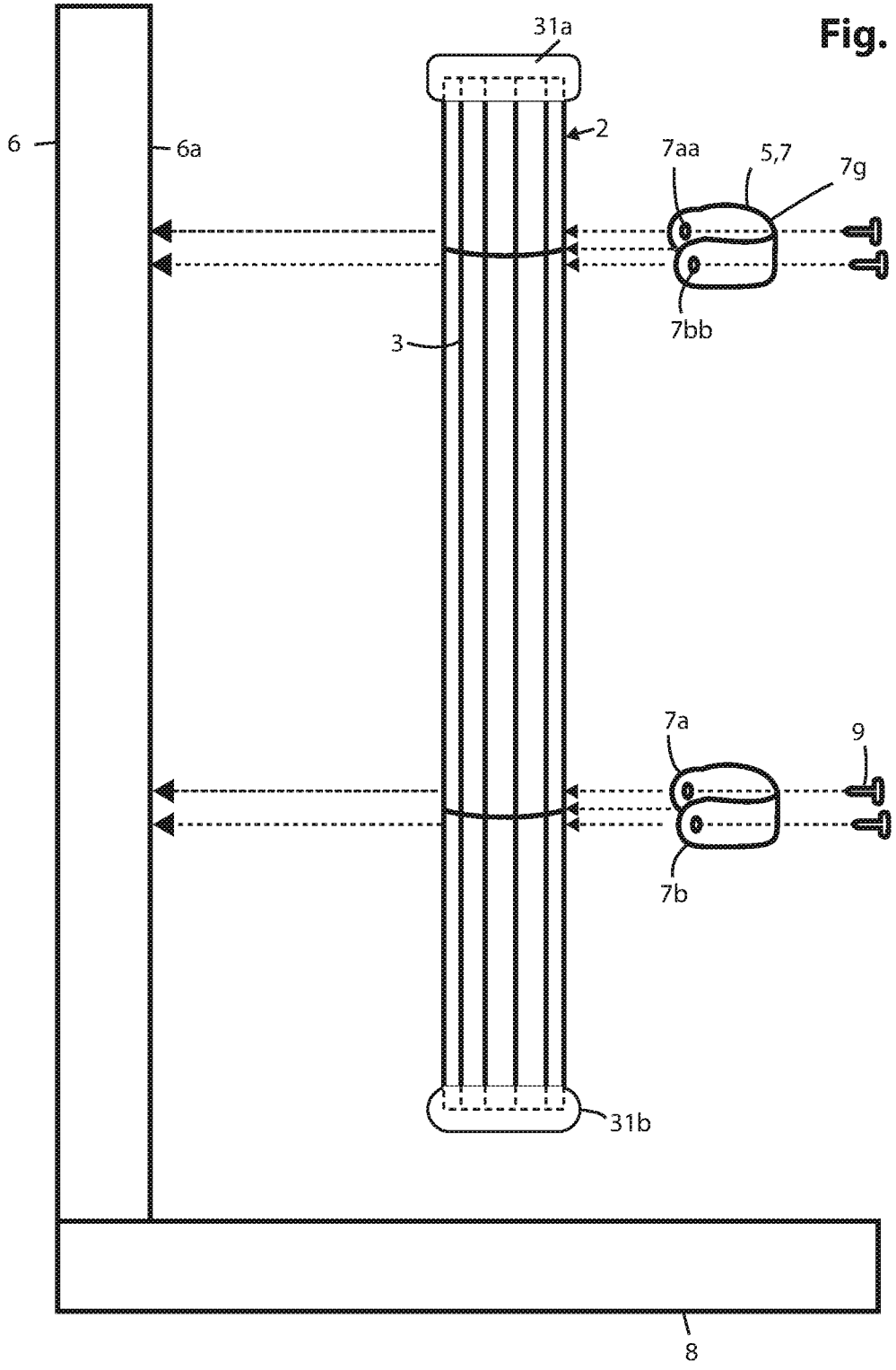
FIG. 3 illustrates shows a lateral exploded view of the preferred embodiment wherein a rigid longitudinal component attaches to another structure with mechanical fasteners.
Figure 8:
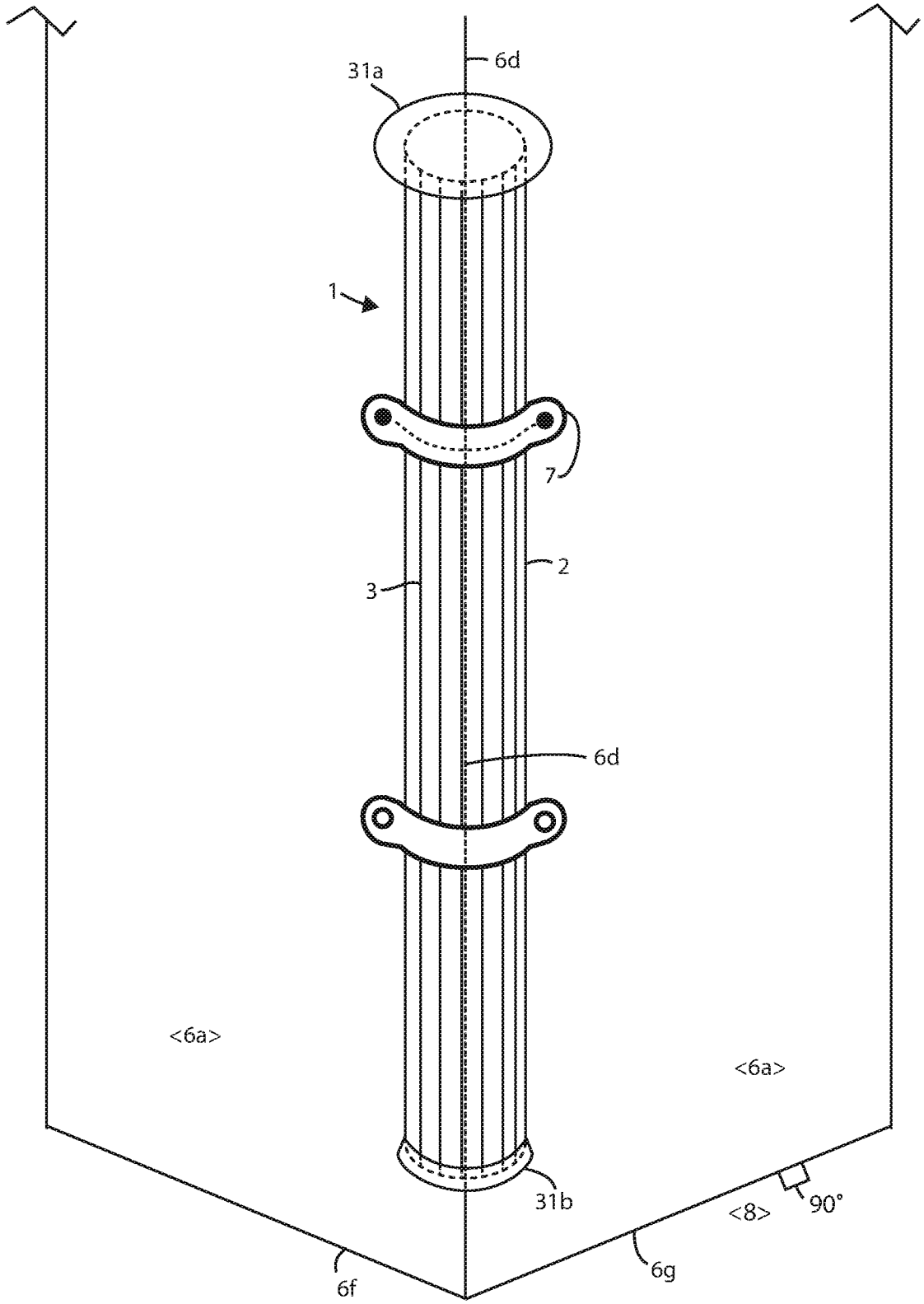
FIG. 8 illustrates a full anterior view of the preferred embodiment attaching to two diverging contacting other structures in the preferred embodiment.
Figure 9:
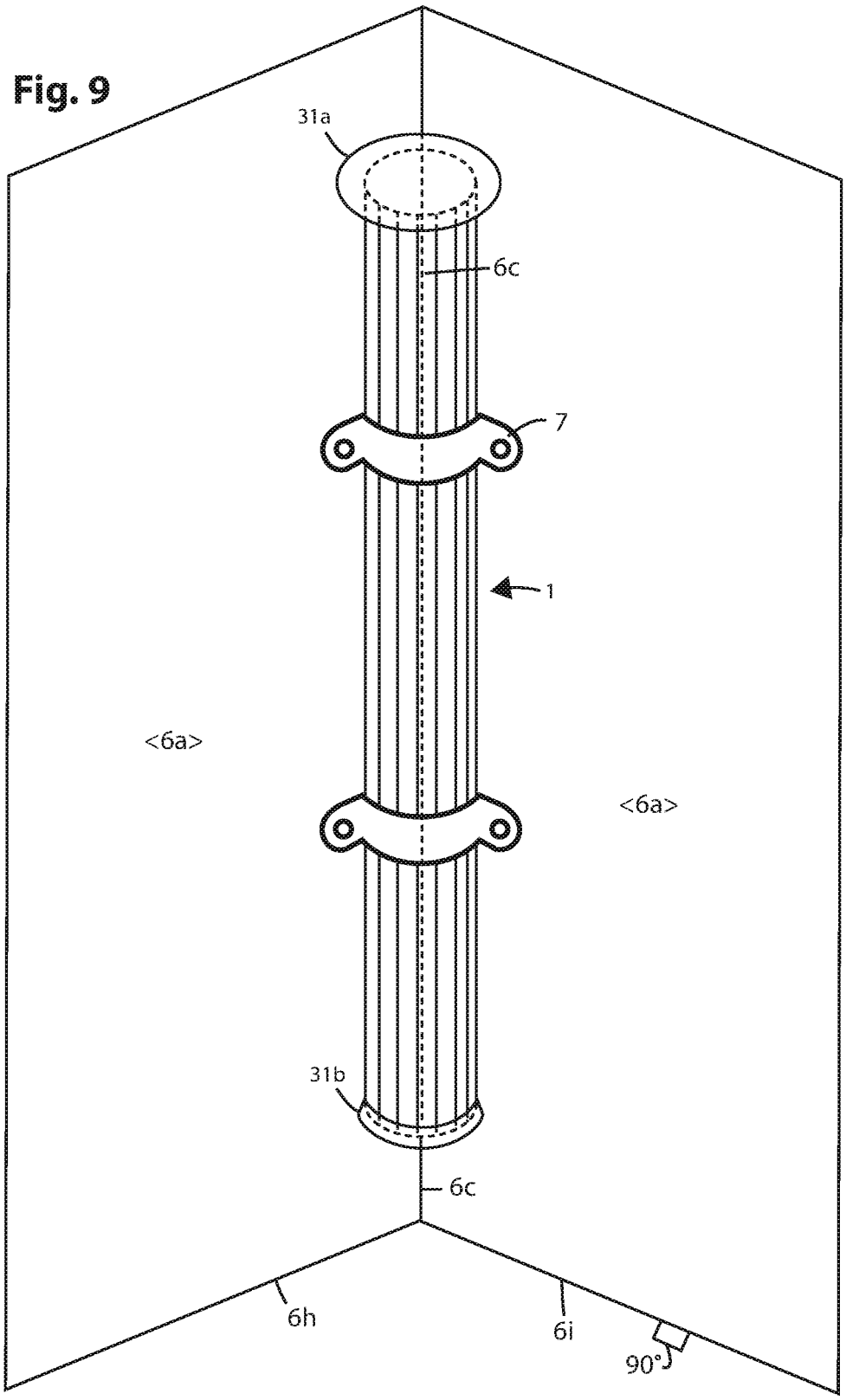
FIG. 9 illustrates a full anterior view of a single greeting card holder in the preferred embodiment which attaches to two contacting converging other structures.

Referring to FIGS. 3, 8 and 9, even more preferably in the preferred embodiment mechanical attachment 5 comprises at least one bracket 7, and in the most preferred embodiment there are at least two brackets 7. At least one bracket 7 preferably partially encompasses (i) a perpendicular cross-section 2*i* of rigid longitudinal component 2 or (ii) approximate perpendicular cross-section 2*i* of rigid longitudinal component 2. Each bracket 7 also preferably comprises an opposing first bracket end 7*a* and an opposing second bracket end 7*b*. Bracket 7 most preferably mechanically attaches to (i) exterior surface 6*a* of a single another structure 6; or (ii) exterior surfaces 6*a* of at least two converging surfaces or diverging surfaces 6*h*, 6*i*, or 6*f* and 6*g* respectively by rivets or similar devices such as screws 9.

Rivets or screws 9 preferably each traverse a corresponding first opposing bracket end 7*a* and second opposing bracket end 7*b* through corresponding bracket openings 7*aa* and 7*bb* respectively.

Figure 5:
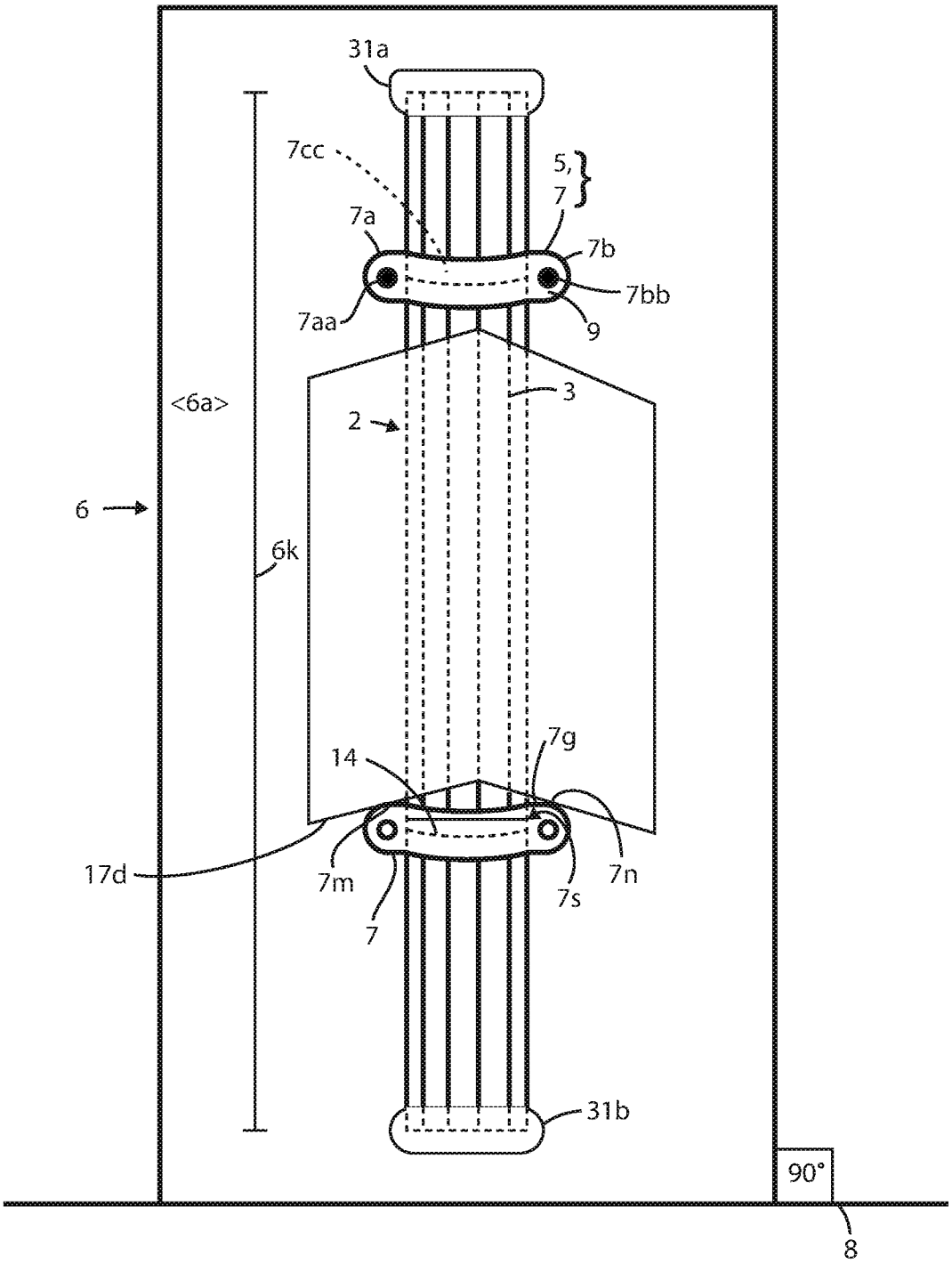
FIG. 5 illustrates a full anterior view of a greeting card holder comprising a single rigid longitudinal component with flexible longitudinal bands, laterally oriented flexible rings and attachment to another structure with brackets in the preferred embodiment.

As seen in FIG. 5, preferably at least one bracket 7 also provides mechanical support for greeting cards or other documents 15 that reversibly insert along rigid longitudinal component 2 as further detailed infra. In this manner greeting cards or other documents 15 are prevented from sliding along rigid longitudinal component 2.

Rigid Polyhedron 9 Embodiment

Figure 6:
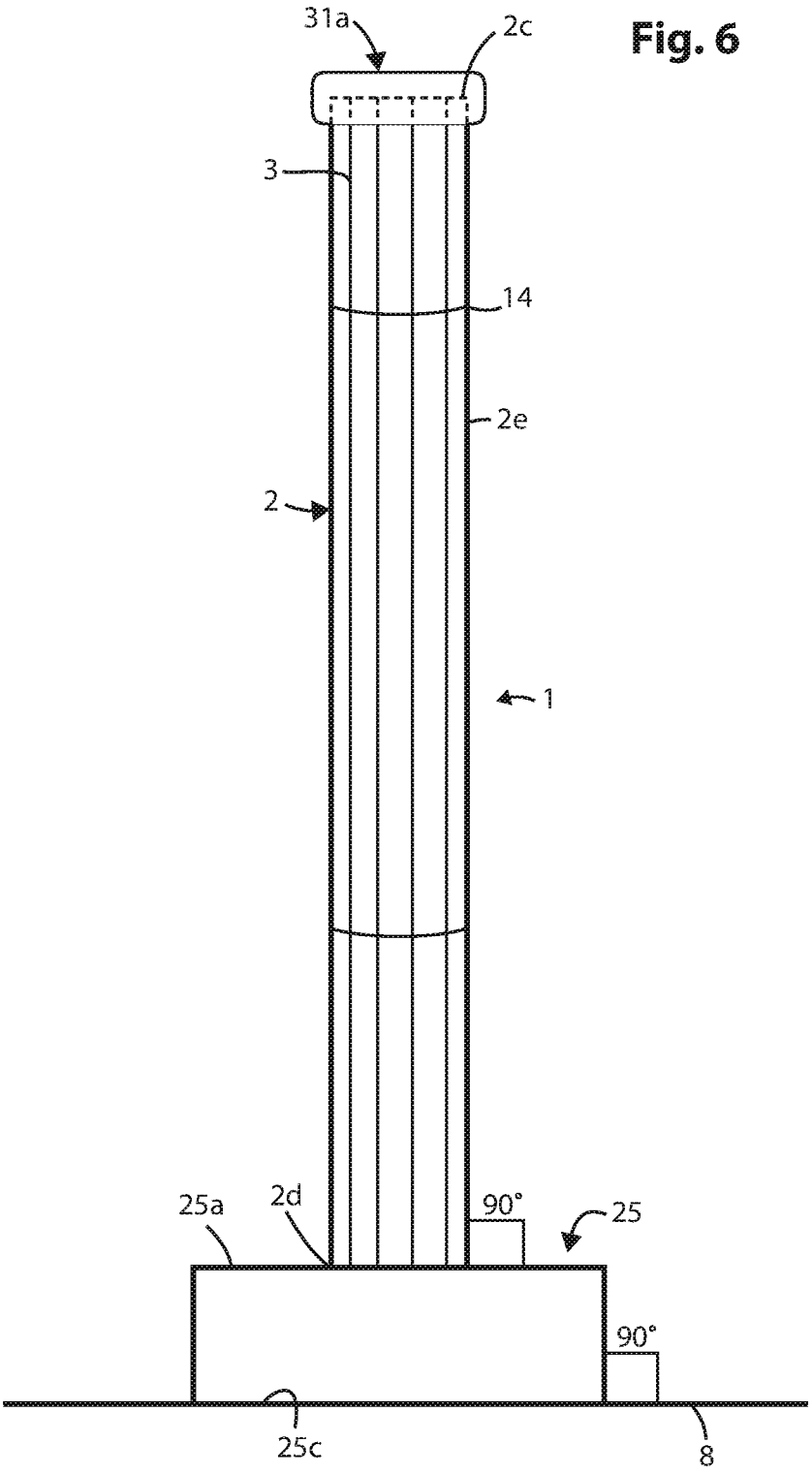
FIG. 6 illustrates a full anterior view of a greeting card holder comprising a rigid longitudinal component, laterally oriented flexible rings, flexible longitudinal bands and a rigid polyhedron.

Referring to FIG. 6, in a second embodiment card holder 1 comprises a rigid polyhedron 25 [hereinafter 'rigid polyhedron 25']. Either of first rigid end 2*c* or second rigid end 2*d* preferably (i) attaches perpendicular to upper rigid polyhedron surface 25*a*, so (ii) the single corresponding rigid longitudinal component 2 is approximately perpendicular, or exactly perpendicular, to upper polyhedron surface 25*a* along entire longitudinal length 2*a*.

Rigid polyhedron 25 is preferably rectangular or square in cross-sectional shape, and may or may not comprise a continuous integral solid. When attached at points 25*b* to upper polyhedron surface 25*a*, (i) rigid longitudinal component 2 is preferably vertically oriented to a lower support contacting surface 8, and (ii) lower support contacting surface 8 preferably supports and contacts lower polyhedron surface 25*c* of rigid polyhedron 25.

Rigid Longitudinal Polyhedron 11 Embodiment

Figure 7:
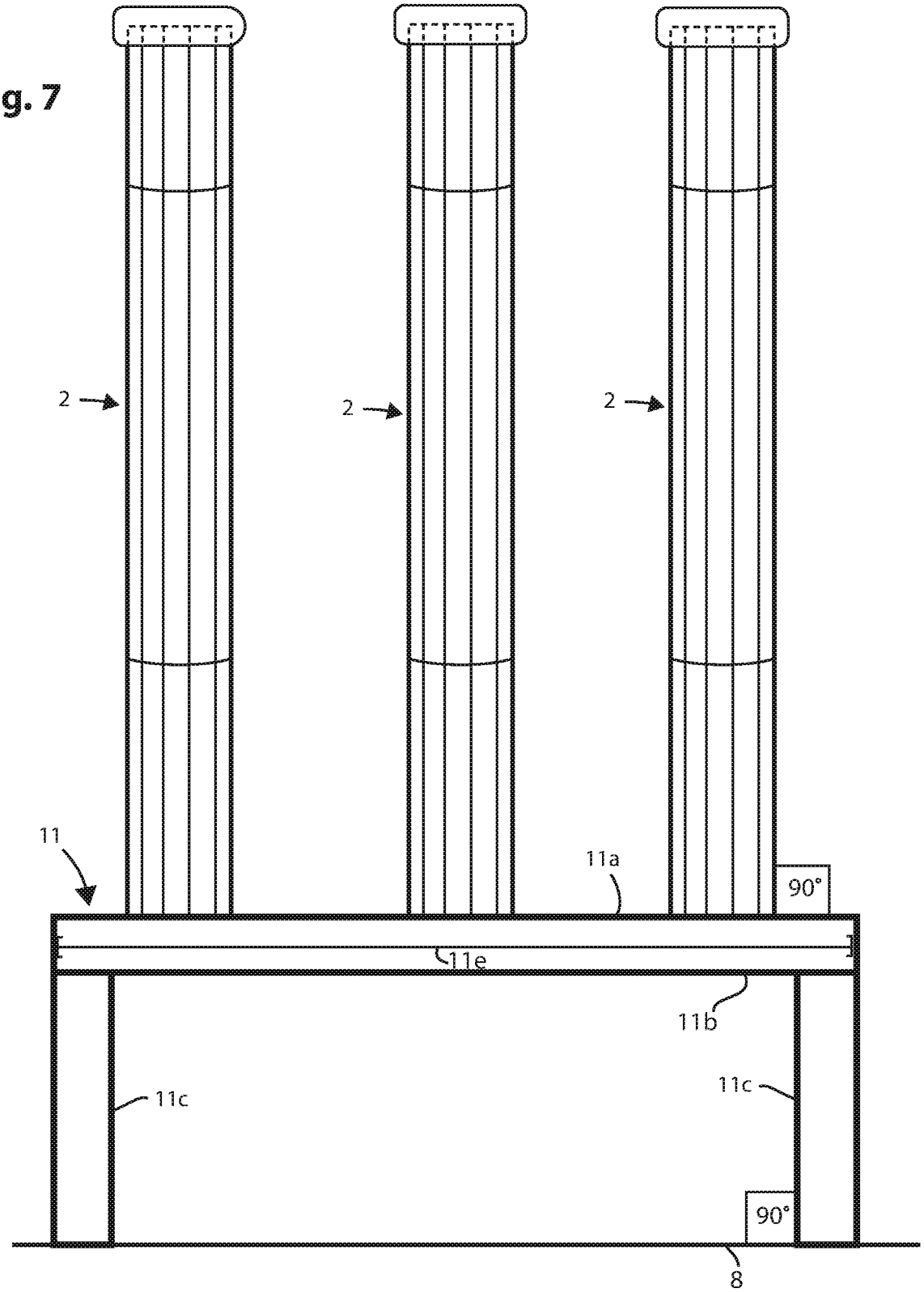
FIG. 7 illustrates a full anterior view of a greeting card holder embodiment comprising three rigid longitudinal components with flexible longitudinal bands, laterally oriented flexible rings and a rigid longitudinal polyhedron.

Referring to FIG. 7, in a third embodiment at least one rigid longitudinal component 2 attaches to preferably a single rigid longitudinal polyhedron 11. Each rigid longitudinal polyhedron 11 preferably comprises an elongated rectangle in longitudinal cross-section, but rigid longitudinal polyhedron 11 may not be continuously or integrally solid. Each rigid longitudinal component 2 preferably attaches exactly or approximately perpendicular to upper rigid longitudinal polyhedron surface 11*a*. Rigid longitudinal polyhedron 11 also may more preferably attach to, and mechanically support a plurality of rigid longitudinal components 2 in spaced alignment along upper rigid longitudinal polyhedron surface 11*a*. Rigid longitudinal polyhedron 11 may also comprise legs 11*c* along lower rigid longitudinal polyhedron table surface 11*b*. In this manner individuals may dine upon, or otherwise congregate around, upper lower rigid longitudinal polyhedron surface 11*a* while viewing greeting cards or other documents 15 along each rigid longitudinal component 2.

Flexible Longitudinal Bands 3 and Laterally Oriented Flexible Rings 14

Referring to FIGS. 1, 2, 2A, 6 and 7, in the preferred embodiment and other embodiments, each rigid longitudinal component 2 preferably mechanically combines with at least one extending flexible longitudinal band 3, more preferably there are at least three extending flexible longitudinal bands 3. A single flexible longitudinal band 3 preferably (i) continuously and integrally stretches approximately parallel or exactly parallel to longitudinal length 2*a* and longitudinal axis 2*h*, and (ii) continuously contacts rigid longitudinal component exterior surface 2*e*. Two or more flexible longitudinal bands 3 preferably longitudinally align exactly or approximately parallel to each other along rigid longitudinal component exterior surface 2*e* and parallel to longitudinal axis 2*h*.

In other varieties of the preferred embodiment and other embodiments, flexible longitudinal bands 3 may (i) align in pairs along exterior rigid longitudinal surface 2*e* in the same parallel manner as described immediately infra, and/or (ii) comprise diverse colors or designs for a more visually appealing greeting card holder 1. Flexible longitudinal bands 3 preferably mechanically attach to first rigid cap 31*a* and second rigid cap 31*b*, but in other embodiments flexible longitudinal bands 3 may attach to (i) only a single first rigid cap 31*a* or a single second rigid cap 31*b*, or (ii) otherwise attach to an upper rigid end 2*c* or a lower rigid end 2*d* without any rigid cap 3*c*. In other embodiments flexible longitudinal bands 3 attach to first rigid cap 31*a*, or second rigid cap 31*b*, first rigid end 31*a* or second rigid end 31*b* by other devices such as but not exclusively, adhesives.

In the preferred embodiment and other embodiments, positioned above and contacting at least one flexible longitudinal band 3 is at least one laterally oriented flexible ring 14 [hereinafter 'flexible ring 14']. Each single flexible ring 14 preferably (i) partially contacts exterior rigid longitudinal component surface 2*e*, and (ii) aligns approximately or exactly perpendicular to each of at least one flexible longitudinal band 3; and.

(iii) completely and continuously encloses a perpendicular cross-sectional perimeter 2*i* of one rigid longitudinal component 2.

Most preferably greeting card holder 1 comprises at least two flexible rings 14 in spaced axial alignment with each other along rigid longitudinal component exterior surface 2*e*. More than two flexible rings 14 are preferably (i) axially aligned and spaced from each other along longitudinal axis 2*h*, and (ii) parallel to each other with respect to each flexible ring diameter 14*f*.

Each flexible ring 14 preferably comprises a rubber band or other elastic or flexible material whose shape snugly conforms to any perpendicular cross-sectional perimeter 2*i*. Flexible rings 14 may also comprise decorative features such as diverse floral arrangements. In some embodiments flexible ring 14 preferably contacts at least one corresponding lower edge 17*d* of a greeting card or other document 15 as described infra.

Greeting Cards or Other Documents 15

Figure 4:
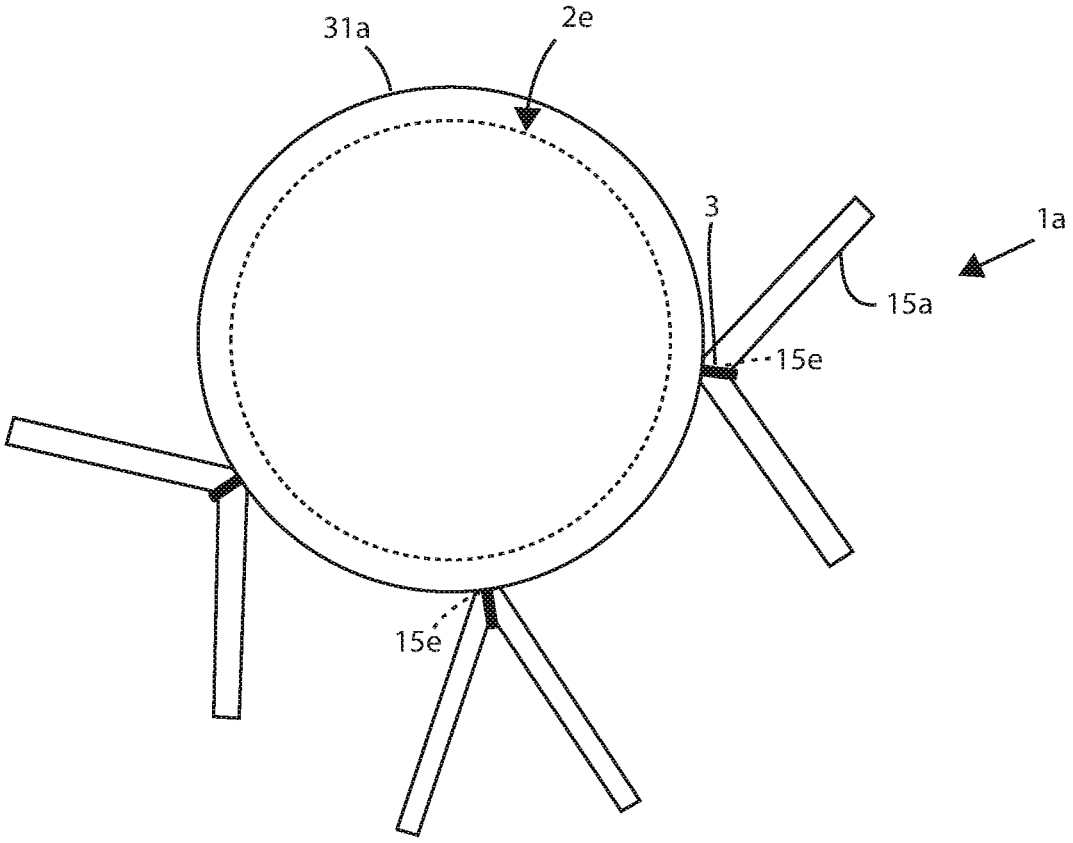
FIG. 4 illustrates an upper plan view of a partial radial configuration of greeting cards or other documents along a rigid longitudinal component.

Referring to FIGS. 1 and 4, in the preferred embodiment and other embodiments, each greeting card or other document 15 comprises at least one first opposing leaf 15*a* and at least one second opposing leaf 15*b* [hereinafter 'opposing leaves 15*a*, 15*b*'respectively]. Preferably each leaf 15*a*, 15*b* also comprises at least one corresponding interior leaf surface 15*c* and at least one corresponding exterior leaf surface 15*d*. Each greeting card or other document 15 also preferably comprises at least one longitudinal fold 15*e*. Preferably longitudinal fold 15*e*

(i) extends linearly and continuously between at least one opposing leaf 15*a* and at least one opposing leaf 15*b* from upper card or another upper document edge 17*c* to (ii) lower greeting card edge or other lower document edge 17*d*.

Each upper greeting card or another upper document edge 17*c*, and each lower greeting card or other lower document edge 17*d*, may comprise more than one opposing leaf 15*a* and/or 15*b*.

More preferably each flexible ring 14 is sufficiently spaced from any adjoining at least one flexible ring 14 to insert at least one greeting card or other document 15 between these same two flexible rings 14 along a corresponding longitudinal fold 15. In particular, at least one additional greeting card or another document 15 may be inserted (i) under the same at least one flexible longitudinal band 3, (ii) in axial spaced alignment with another at least one greeting card or anther document 15, along rigid longitudinal component 2, and (iii) where the additional greeting card or another document 15 may insert only under the same flexible longitudinal band 3 or (iv) more than one adjoining flexible longitudinal band 3.

In other embodiments as well as the preferred embodiment, at least one additional greeting card or other document 15 may (i) reversibly insert beneath a different single longitudinal flexible band 3 in either axial direction along a single rigid longitudinal component 2, and (ii) thereby be spaced from the original greeting card(s) or other document(s) 15 in a non-linearly aligned manner. As a result, the user may insert greeting cards or documents 15 along original corresponding longitudinal folds 15*e*. The user may then remove some or all of these original greeting cards or other documents 15, and reversibly replace them with new greeting cards or other documents 15

(i) in original insertion positions, partially new positions, or (ii) completely different axial and/or circumferential/perimeter positions along rigid longitudinal component 2.

Still referring to FIG. 1, in the preferred embodiment and other embodiments each greeting card or other document 15 preferably reversibly attaches to rigid longitudinal support 2 by inserting longitudinal fold 15*e* between (i) exterior longitudinal surface 2*e* and (ii) at least one flexible longitudinal flexible 3. Each inserted longitudinal fold 15*e* is preferably exactly parallel, or approximately parallel, to longitudinal length 2*a* and longitudinal axis 2*h*. As a result, each inserted greeting card or other document 15 appears uniformly vertical in orientation if rigid longitudinal component 2

(i) attaches to other structures 6, 6*h* and 6*i*, and 6*f*, 6*g* as described supra, and (ii) whenever the longitudinal length(s) 6*k* of the contour of other structure exterior surface(s) 6*a* align perpendicular to a lower contacting supporting surface 8.

Each at least one greeting card or other document 15 preferably reversibly attaches to rigid longitudinal component 2 by inserting longitudinal fold 15*e* between exterior rigid longitudinal surface 2*e* and at least one flexible longitudinal band 3. Most preferably, each longitudinal fold 15*e* should congruently align with a corresponding flexible longitudinal band(s) 3. However, in other embodiments each longitudinal fold 15*e* congruently aligns with a series of adjacent longitudinal folds 15*e*. In this preferred orientation greeting cards or other documents 15 now (i) appear 'right side up' with respect to all greeting card or other document surfaces 15*a*, 15*b*, 15*c* and 15*d*, and (ii) therefore illustrations or written subject matter are within the user's proper view. Most preferably greeting cards or other documents 15 are also vertical and perpendicular (approximately or exactly) to a contacting supporting surface 8 whenever (i) at least one rigid longitudinal component 2 attaches, (ii) parallel to another structure(s) 6, 6*h* and 6*i* or 6*f* and 6*g* which are perpendicular to lower contacting supporting surface 8.

Each greeting card or other document 15 is preferably maintained at a specific axial position along rigid exterior surface 2*e* of longitudinal component 2 by (i) at least one flexible ring 14, and (ii) where the at least one flexible ring 14 axially positioned along longitudinal length 2*a* as described supra.

This maintenance is accomplished along rigid exterior longitudinal surface 2*e* by at least one flexible ring 14

(i) physically abutting lower edge 17*d* of at least one greeting card or other document 15 at no less than on flexible ring point 14*m* and/or 14*n*, and (ii) (ii) where this abutment along lower edge 17*d* at flexible rings points 14*m* and 14*n* is proximal to a corresponding longitudinal fold 15*e*.

As best seen in FIG. 5, in the most preferred embodiment at least one lower edge 17*d* of at least one greeting card or other document 15 is preferably supported by an upper rigid bracket edge 7*g* which (i) most preferably abuts greeting card or other document lower edge 17*d* at no less than two points, (ii) i.e., bracket point 7*m* and bracket point 7*n*, whenever bracket 7 congruently aligns with at least one underlying flexible ring 14.

In some alternative embodiments other mechanical fasteners 5 may or may not abut a greeting card or other document lower edge 17 depending upon the fastener design and dimensions.

In those embodiments without mechanical fasteners 5, flexible ring 14 sufficiently frictionally engages exterior rigid longitudinal surface 2*e* to (i) prevent an inserted greeting card or other document 15 from sliding along rigid longitudinal exterior surface 2*e*, (ii) while each greeting card or other document 15 is positioned beneath at least one flexible longitudinal band 3. Preferably the tension within each at least one flexible longitudinal band 3 results from reversible mechanical stretching or elongation of each flexible longitudinal band 3 between uppermost longitudinal end 2*c* and lowermost longitudinal end 2*c*. However, most preferably each corresponding bracket 7, or other mechanical attaching device 5, congruently positions over a corresponding axially positioned flexible ring 14 in the preferred embodiment.

Referring to FIG. 4, in some embodiments greeting card holder 1 creates a radial document pattern 1*a* whenever one or more flexible longitudinal band 3*s* simultaneously compress inserted greeting cards or other documents 15 along one or more perpendicular cross-sectional perimeters 2*i*. These greeting cards or other documents 15 preferably axially align with remaining inserted greeting cards or other documents 15. However, these greeting cards or other documents 15 are not necessarily linearly aligned with each other although they are axially aligned with each other.

Furthermore, in most embodiments preferably two flexible rings 14

(i) are axially positioned with respect to each other along rigid exterior longitudinal surface 2*e*, and (ii) frictionally and otherwise mechanically support at least two radially protruding greeting cards or other documents 15 along greeting card lower edges 17*d* in those embodiments without appropriately sized brackets 7 or other mechanical fasteners 5.

Preferably, at least one inserted greeting card or other document 15 protrudes in other reversible configurations from between rigid longitudinal exterior surface 2*e* and at least one flexible longitudinal band 3. Alternatively, in most embodiments with a plurality of separate flexible longitudinal bands 3, radial displays 1*a* of more than one greeting card or other documents 15 are possible whenever (i) more than one greeting cards or other documents 15 protrude outwardly from (ii) a rigid longitudinal component 2 along perpendicular cross-sectional perimeter(s) 2*i* in (iii) partial radial display 1*a*, or (iv) 360-degree radial display 1*a*.

In the preferred embodiment and other embodiments, at least one greeting card or another document 15 reversibly inserts beneath one flexible longitudinal flexible band 3. In other embodiments each axially aligned greeting card or other document 15 inserts under (i) a plurality of single flexible longitudinal bands 3 or (ii) an aligned parallel closely adjoining pair of flexible longitudinal bands 3. Please see FIGS. 2, 2A and 2B.

Attachment of Greeting Card Holder 1 to Another Structure (s) 6, 6*h* and 6*i*, and 6*f* and 6*g*

In the most preferred embodiment, a cylindrical rigid longitudinal component 2 attaches to a single another structure 6, so longitudinal length 2*a* is parallel to the longitudinal contour 6*k* of the single another structure's exterior surface 6*a*. FIG. 5. Inserted longitudinal folds 15*e* preferably axially align along rigid longitudinal component 2 (although not necessarily simultaneously inserted under the identical flexible longitudinal band 3 and therefore not necessarily in linear alignment). More preferably greeting cards or other documents 15 axially align along rigid longitudinal component 2 perpendicular and vertically to a supporting surface 8 whenever the longitudinal axis 2*h* and longitudinal length 2*a* of this at least one single rigid longitudinal component 2 attaches parallel to (i) the longitudinal contour 6*k* of another structure's exterior surface 6*a* (such as a wall), and (ii) when another structure 6 is positioned approximately perpendicular, or exactly perpendicular, to a lower supporting contacting surface 8 such as a floor. Please see FIGS. 3, 5, 8 and 9. However, it is also satisfactory in other embodiments if longitudinal folds 15*e* are each inserted in (i) axial alignment with each other along the longitudinal length 2*a* and longitudinal axis 2*h* of a single rigid longitudinal component 2, and (ii) parallel to the longitudinal length 2*a* and longitudinal axis 2*h* of this same single rigid longitudinal component 2, but (ii) without regard to the longitudinal contour 2*k* or any other spatial orientation of the attached another structure 6.

Each horizontal bracket dimension 7*s* preferably axially aligns exactly or approximately in parallel with, and is axially positioned above or below (i) each remaining horizontal bracket dimension 7*s*

(ii) along longitudinal length 2*a* and longitudinal axis 2*h*.

In the preferred embodiment (i) whenever each bracket 7 is positioned over and above a corresponding flexible ring 14, (ii) then each bracket 7 preferably attaches to a single other structure 6 at first opposing bracket end 7*a* and second opposing bracket end 7*b* with rivets or screws 9 along exterior surface 6*a*.

In other embodiments in which the greeting card holder attaches to at least two converging structures 6*h* and 6*i*, then each opposing bracket end 7*a* attaches to either of exterior surfaces 6*a* of corresponding converging structures 6*h* or 6*i*. Each opposing bracket end 7*a*, 7*b* may attach to either of these at least two exterior surfaces 6*a* of corresponding converging structures 6*h* or 6*i*, so each bracket 7 simultaneously attaches to both converging structures 6*h* and 6*i* at two opposing bracket ends 7*a*,7*b*. Similarly, for diverging other structures 6*f* and 6*g* each opposing bracket end 7*a*, 7*b* may attach to either of exterior surfaces 6*a* of a corresponding diverging structure 6*f* or 6*g*, so each single bracket 7 simultaneously attaches to both diverging structures 6*f* and 6*g* at opposing bracket ends 7*a*, 7*b*. Please see FIGS. 8 and 9.

Rigid Polyhedron 25 or Rigid Longitudinal Polyhedron 11

Referring to FIG. 6, in other embodiments at least one rigid longitudinal component 2 combines with at least one flexible longitudinal band 3 and at least one flexible ring 14 in the manners described supra, and while simultaneously attaching to preferably a single rigid polyhedron 25. Rigid polyhedron 25 is not necessarily integrally and continuous solid. More preferably rigid longitudinal component 2, while combined with at least one flexible longitudinal band 3 and at least one flexible ring 14, preferably attaches to single rigid polyhedron 25 at rigid polyhedron upper exterior surface 25*a* in (i) an exact perpendicular manner or (ii) an approximately perpendicular manner. A single rigid longitudinal component 2 preferably attaches to rigid polyhedron 25 at either first rigid end 2*c* or second rigid end 2*d*. Rigid polyhedron 25 is preferably supported upon, and contacts the contacting supporting surface 8 in an approximate perpendicular manner or an exact perpendicular manner along its lowermost rigid polyhedron surface 25*c*.

Referring to FIGS. 6 and 7, in still other embodiments one or more rigid longitudinal component 2 is approximately perpendicular, or exactly perpendicular, to a single rigid longitudinal polyhedron 11. Rigid longitudinal polyhedron 11 is not necessarily continuously, integrally or completely solid. In these embodiments, either first rigid end 2*c* or second rigid end 2*d* preferably attach to rigid longitudinal polyhedron upper surface 11*a*. However, other attachments, such as but not exclusively adhesives, are also satisfactory for attaching a second rigid end 2*d* to rigid longitudinal polyhedron upper surface 11*a*. The longitudinal length 2*a* and longitudinal axis 2*h* of each attached at least one rigid longitudinal component 2 preferably are each exactly perpendicular, or approximately perpendicular, to rigid longitudinal polyhedron upper surface 11*a*.

Each attached rigid longitudinal component 2 preferably exhibits an upright vertical position whenever (i) rigid polyhedron 11 is supported by a supporting contacting lower surface 8, and wherein (ii) supporting contacting lower surface 8 is perpendicular to longitudinal length 2*a*, and (iii) lowermost longitudinal polyhedron exterior surface 25*c* contacts lower supporting contacting supporting surface 8.

In another embodiment, rigid longitudinal polyhedron 11 comprises a table with legs 11*c* whenever longitudinal length 11*e* of rigid longitudinal polyhedron 11 is parallel to supporting contacting lower surface 8. With this embodiment people may dine upon or otherwise engage the invention as a table while enjoying single or multiple greeting cards or other documents 15 displayed upon one or more upright rigid longitudinal components 2.

All the above embodiments comprise utility for a business office in which projects, memos and other papers are displayed until more recent documents replace then. The foregoing disclosure of the present invention is presented as illustration and description only. This disclosure is not exhaustive and does not limit the present invention to the precise forms disclosed, and so consequently many modifications and variations are possible in light of the above written descriptions and figures.

The invention claimed is:

1. A greeting card holder comprising (A) a longitudinal component, said longitudinal component further comprising perpendicular cross-sectional perimeters, and a first longitudinal length and an axial length, said axial length congruently aligning with said first longitudinal length, said perpendicular cross-sectional perimeters being perpendicular to said first longitudinal length and said axial length, and said longitudinal component exclusively exhibiting rigid behavior, (B) at least one longitudinal band exclusively exhibiting flexible behavior, said at least one longitudinal band contacting said longitudinal component, said at least one longitudinal band comprising a second longitudinal length, and said second longitudinal length aligning parallel to and along said first longitudinal length, and (C) at least two laterally oriented rings, said at least two laterally oriented rings exclusively exhibiting flexible behavior, said at least two laterally oriented rings each comprising a ring diameter, and each said ring diameter being positioned perpendicular to said second longitudinal length along said longitudinal component, and said at least two laterally oriented rings being physically separate structures from said longitudinal component and said at least one longitudinal band, and one greeting card or a plurality of greeting cards inserting between said longitudinal component and said at least one longitudinal band, and said at least two laterally oriented rings preventing said one greeting card or said plurality of greeting cards from moving along said longitudinal component, and said at least two laterally oriented rings maintaining said plurality of greeting cards along one or two of said perpendicular cross-sectional perimeters, and one of said at least two laterally oriented rings maintaining said single greeting card along one of said two perpendicular cross-sectional perimeters, said plurality of greeting cards being aligned within spaced intervals along said first longitudinal length and axial length.

2. The greeting card holder of claim 1, comprising a single mechanical attaching device or mechanical attaching devices, said single mechanical attaching device or said mechanical attaching devices attaching said longitudinal component to a single protruding structure or two said protruding structures, said two protruding structures comprising a longitudinal converging angle or a longitudinal diverging angle, and said longitudinal converging angle and said longitudinal diverging angle each comprising a protruding longitudinal length, and said first longitudinal length being parallel to said protruding longitudinal length, and said longitudinal component continuously contacting said longitudinal angle.

3. The greeting card holder of claim 1 further comprising a first mechanical attaching device and a second mechanical attaching device, attaches said first mechanical attaching device and said second mechanical attaching device each attaching said longitudinal component to a first surface and a second surface, said first surface and said second surface each being perpendicular to a third supporting surface, and said first surface comprising a first surface longitudinal length and said second surface comprising a second surface longitudinal length, said first longitudinal length being parallel to said first surface longitudinal length and said second surface longitudinal length, and said first mechanical attaching device and said second mechanical attaching device being axially spaced from each other along said axial length.

4. The greeting card holder of claim 1 comprising a first bracket and a second bracket, said first bracket and said second bracket each being axially aligned from each other along said longitudinal component, said and a said laterally oriented ring congruently aligning with a single corresponding said first bracket or a single corresponding said second bracket, and said first bracket and said second bracket each being positioned above a single corresponding said laterally oriented ring, and each said congruently aligning laterally oriented ring and said first bracket retaining a portion of said plurality of greeting cards at more than one predetermined axial position along said first longitudinal length, and said portion of said plurality of greeting cards continuously aligning along a first said cross-sectional perpendicular perimeter by a corresponding first said laterally oriented ring, and a remainder of said plurality of greeting cards continuously aligning along a second said cross-sectional perpendicular perimeter by a said corresponding said lateral oriented ring.

5. The greeting card holder of claim 1, said longitudinal component comprising a first holder end and a second holder end, said first holder end or said second holder end comprising a polyhedron, said polyhedron providing mechanical support and a free-standing capability for said longitudinal component whenever said longitudinal component attaches to said polyhedron, and said polyhedron contacting an unattached third surface, and said third surface not attaching or comprising part of said greeting card holder.

6. The greeting card holder of claim 1 comprising at least one mechanical attaching device, and and said at least one mechanical attaching device abutting said single card or said plurality of cards, said at least one mechanical attaching device also attaching said longitudinal component to at least one physically separate protruding surface, and said at least one physically separate protruding surface being physically separate from said longitudinal component, said at least one longitudinal band and said at least one laterally oriented ring.

7. The greeting card holder of claim 1 said plurality of greeting cards comprising several groups of greeting cards, and each said laterally oriented ring frictionally maintaining a said group of said plurality of greeting cards at a predetermined axial position along said longitudinal component, and said cards within a first said group of said greeting cards being continuously positioned along a single said corresponding said perpendicular cross-sectional perimeter in a continuous radial manner, and remaining said groups of said greeting cards each being positioned along remaining said corresponding said perpendicular cross-sectional perimeters in a continuous radial manner.

8. A document display apparatus comprising a longitudinal component, said longitudinal component comprising a first longitudinal length and an axial length, said axial length congruently aligning with said first longitudinal length, and said document display apparatus further comprising (A) one longitudinal band or a plurality of said longitudinal bands, said one longitudinal band or said plurality of longitudinal bands each comprising a second longitudinal length cross, said one longitudinal band or said plurality of longitudinal bands each enclosing said longitudinal component, and said second longitudinal length being parallel to said first longitudinal length, and B. a first retaining device exclusively displaying flexible behavior and a second retaining device exclusively displaying flexible behavior, and said first retaining device and said second retaining device each comprising a retaining device diameter, and said retaining device diameters each being perpendicular to said axial length and said longitudinal length, said first retaining device and said second retaining device each axially aligning along said first longitudinal length in a spaced relationship to each other, and said first retaining device and said second retaining device each enclosing said single longitudinal band or each of said plurality of longitudinal bands approximately perpendicular to said second longitudinal length, and said first retaining device and said second retaining device each comprising a physically separate and distinct device from said longitudinal component, said single longitudinal band or each of said plurality of longitudinal bands, and said first retaining device or said second retaining device mechanically maintaining a single document at a single axial position along said first longitudinal length, and said first retaining device and said second retaining device mechanically maintaining said plurality of documents at diverse axial positions or said single axial position along said first longitudinal length.

9. The document holder of claim 8 wherein said plurality of documents, comprises at least two document groups, said first device maintaining a first said document group at a first axial position along said longitudinal component, and said second device maintaining a second said document group at a second axial position along said longitudinal component, and said first said document group being positioned along an entire first said perpendicular cross-sectional perimeter, and said second said document group is positioned along another entire second said perpendicular cross-sectional diameter.

10. The document holder of claim 8, and each retaining device comprising a laterally oriented ring, said laterally oriented ring retaining said one document or said plurality of documents in an orientation parallel to said first longitudinal length, and each laterally oriented ring retaining said one document or said plurality of documents in an enclosing orientation along a corresponding perpendicular cross-sectional perimeter, and said enclosing orientation being approximately perpendicular to said first longitudinal length.

11. An apparatus for supporting and displaying documents comprising

A. a longitudinal component comprising a first longitudinal length and at least two perpendicular cross-sectional perimeters, said at least two perpendicular cross-sectional perimeters being perpendicular to said first longitudinal length, and B. at least one longitudinal band contacting said longitudinal component, said at least one longitudinal band comprising a second longitudinal length, and said second longitudinal length aligning parallel to sad first longitudinal length, and B. at least one laterally oriented ring, said at least one laterally oriented ring exclusively exhibiting flexible behavior, said at least one laterally oriented ring being positioned perpendicular to said first longitudinal length along said longitudinal component, and a single document or a plurality of documents inserting between said at least one longitudinal band and said longitudinal component, said at least one laterally oriented ring retaining said plurality of documents at spaced axial positions along said longitudinal components, and said at least one laterally orienting ring preventing said single document or said plurality of documents from sliding along said longitudinal component, and said plurality of documents comprising a partial or complete radial array of said inserted documents along at least one of said at least two perpendicular cross-sectional perimeters, and D. at least one mechanical attaching component, said at least one mechanical attaching component attaching said longitudinal component to at least one separate surface, and said at least one mechanical attaching component also comprising a mechanical retaining device, said mechanical retaining device preventing said single document or said plurality of documents from sliding along said longitudinal component.

12. A document holder comprising a longitudinal component, said longitudinal component further comprising an axial longitudinal length and perpendicular cross-sectional perimeters, said document holder further comprising one pair or two pairs, and each said pair comprising a first mechanical device and a second mechanical device, and said first mechanical device and said second mechanical device within each said pair congruently aligning with each other, and said two pairs being in spaced axial alignment with each other along said axial longitudinal length, and each said first mechanical device supporting documents along said axial longitudinal length, and each said first mechanical device supporting documents in a radial manner along a said perpendicular cross-sectional perimeter or two said perpendicular cross-sectional perimeters, and each said second mechanical device supporting documents along said axial longitudinal length, and each said second mechanical device supporting documents along a portion of one entire said perpendicular cross-sectional perimeter, and each said second mechanical device attaching said longitudinal component to a separate protruding surface or separate protruding surfaces.

* * * * *